United States Patent [19]

Taylor

[11] 4,069,927

[45] Jan. 24, 1978

[54] ANCHOR MEMBER FOR UNITIZING A PLURALITY OF CONTAINERS

[76] Inventor: Charles F. Taylor, 2160 El Cajonita Drive, La Habra, Calif. 90631

[21] Appl. No.: 679,090

[22] Filed: Apr. 21, 1976

[51] Int. Cl.[2] ..... B65G 1/14

[52] U.S. Cl. ..... 214/10.5 R; 105/366 E; 105/463; 206/821

[58] Field of Search ..... 105/373, 486, 463, 489, 105/366 R, 366 E; 214/10.5 R; 206/821

[56] References Cited

U.S. PATENT DOCUMENTS

| | | | |
|---|---|---|---|
| 1,514,512 | 11/1924 | Fisher | 214/10.5 R |
| 1,519,901 | 12/1924 | Boaz et al. | 214/10.5 R |
| 1,638,612 | 8/1927 | Baus | 214/10.5 R X |
| 2,120,610 | 6/1938 | Howard | 206/821 X |
| 2,851,188 | 9/1958 | Pavelle | 214/10.5 R X |
| 2,905,114 | 9/1959 | Olson | 214/10.5 R X |
| 3,250,564 | 5/1966 | Stern et al. | 206/821 X |
| 3,580,186 | 5/1971 | Pierce | 105/490 |

*Primary Examiner*—Frank E. Werner

*Attorney, Agent, or Firm*—Shlesinger, Arkwright, Garvey & Dinsmore

[57] ABSTRACT

A substantially flat anchor member for positioning at the juncture between a plurality of containers for enabling the same to be moved as a unit. Wall means depending from the anchor member fit between the containers and cleats extending from the body of the anchor member penetrate adjacent containers to secure the same together. Cleats extending from the opposite face of the anchor member body penetrate the bottom of a container or containers placed on top of the anchor member. For open tray type containers used in shipping bottles, cans, etc., complemental retaining wall means extending from the opposite face of the anchor member engage the top of a bottle or can in the tray, thereby holding adjacent trays together.

15 Claims, 10 Drawing Figures

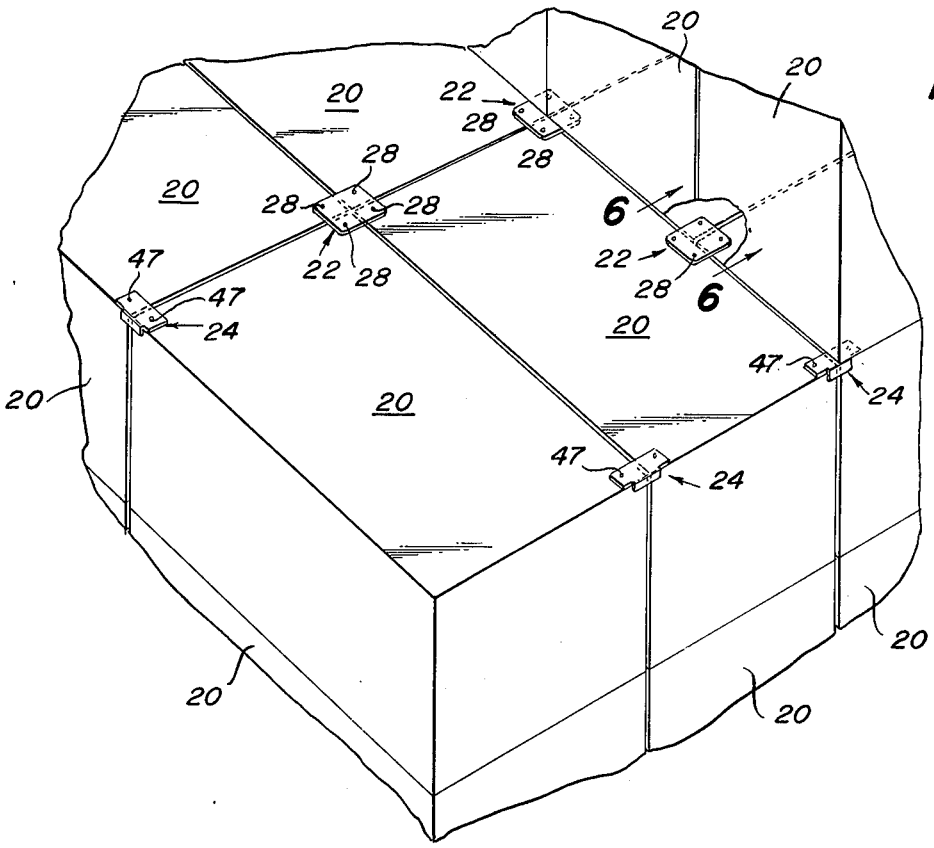
Fig. 1
Fig. 2
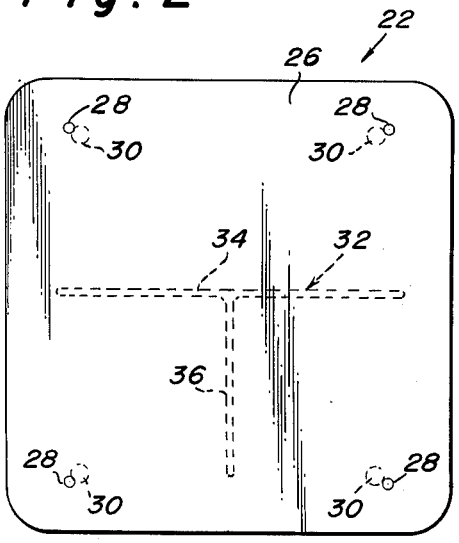
Fig. 3
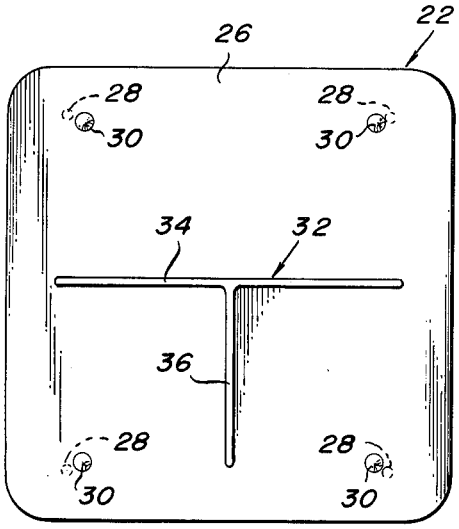
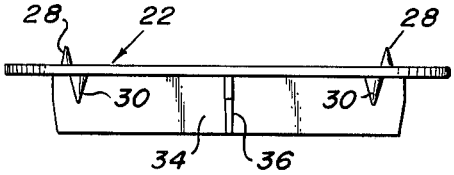
Fig. 4
Fig. 5
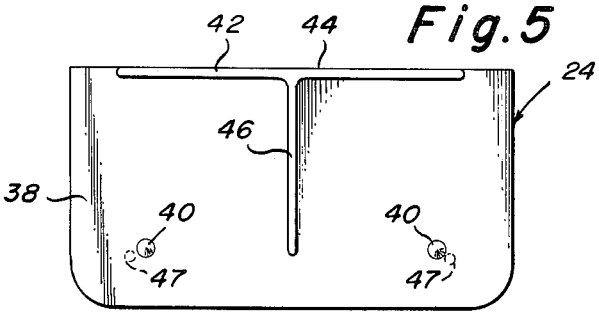

Fig. 6
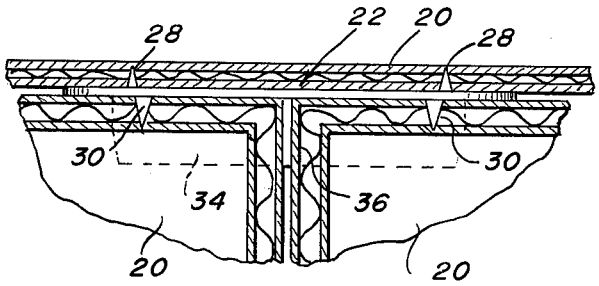
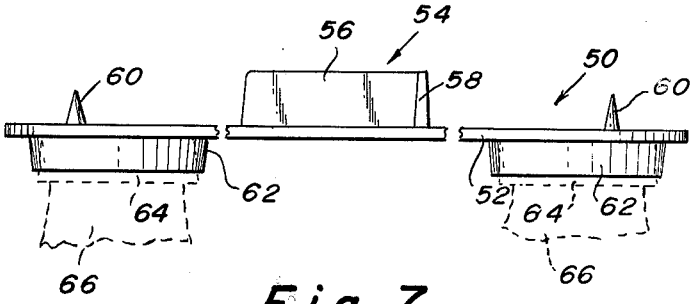
Fig. 7
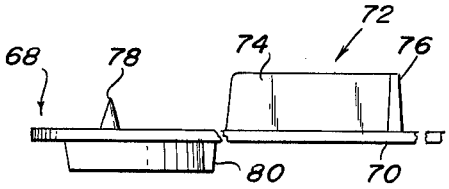
Fig. 9
Fig. 8
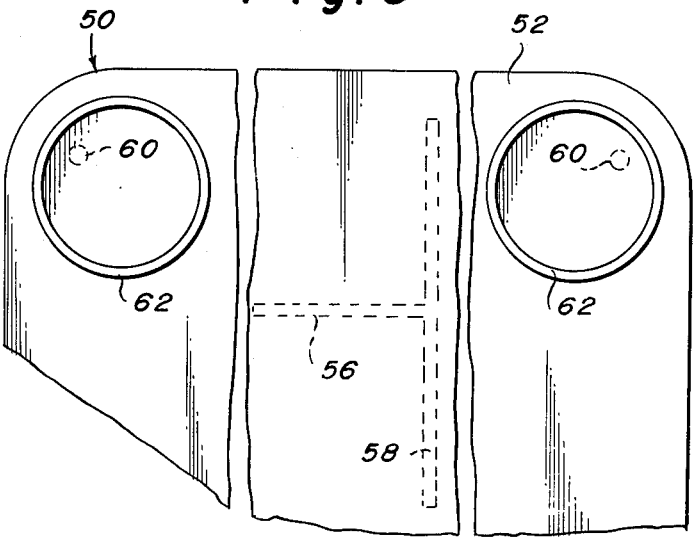
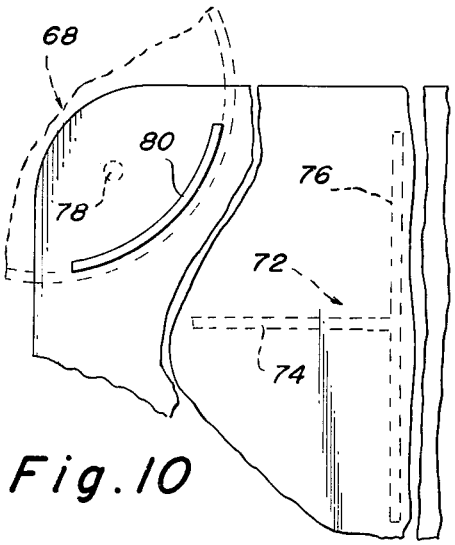
Fig. 10

ANCHOR MEMBER FOR UNITIZING A PLURALITY OF CONTAINERS

BACKGROUND OF THE INVENTION

In the transportation or movement of large containers, such as cartons, trays or the like, it is conventional practice to employ mechanical means such as forklifts for lifting a plurality of the containers at one time. Difficulty has been experienced in the handling of containers in this manner because of the tendency of the containers to separate from each other while being transported. The containers must then be reassembled into a unit thereby causing delays in the process. Various attempts have been made to solve this problem by use of banding means or the like for holding the cartons together but such means are necessarily time consuming to apply and remove, and result in additional expenditure for the banding equipment and labor required to apply the same. Other retaining means have proven only partially satisfactory in retaining the cartons in position and have not, therefore, been universally accepted in use for this purpose.

SUMMARY OF THE INVENTION

The anchor member of the present invention is a simple, economical device for holding and retaining as a unit, a plurality of contiguous containers such as boxes or trays arranged adjacent to each other and in stacked relationship.

The anchor member includes a flat body having cleats or pins extending outwardly from one or both faces thereof, the member being positioned at the juncture between a plurality of containers, with the cleats penetrating the walls of adjacent containers to positively prevent relative movement thereof. The member further includes wall means extending from one face of the flat body, which wall means are insertable between the contiguous containers for holding the anchor member in place.

The device of the present invention further includes cleats or pins on the opposite face thereof which penetrate a container or containers superimposed on a lower container, thereby also unitizing the two layers of containers. This permits the stacking of boxes to any desired height by placing anchor members on each layer of cartons.

The anchor member is preferably provided with wall means of T-shaped configuration which is located on half of the anchor member, thereby permitting the same to be used for application to the outside edges of adjacent cartons by removal of the remaining half of the anchor member.

The anchor member may also include the addition of a second wall member on the side opposite the T-shape wall which second wall is adapted to complement and engage, the upper limit of containers such as cans, tubes, bottles, etc., which are carried in an open tray or the like.

DESCRIPTION OF FIGURES OF THE DRAWINGS

FIG. 1 is a perspective view of a plurality of containers illustrating the use of the present invention;

FIG. 2 is a top plan view of the anchor member of the present invention;

FIG. 3 is a bottom plan view of the same;

FIG. 4 is an edge elevational view of the same;

FIG. 5 is a bottom plan view of the modified form of the anchor member of the present invention;

FIG. 6 is an enlarged sectional view taken along the line 6—6 of FIG. 1, looking in the direction of the arrows;

FIG. 7 is an edge elevational view of another modified form of the present invention illustrating its use, FIG. 8 is a bottom plan view of the form of invention illustrated in FIG. 7;

FIG. 9 is an end elevational view of a further modification of the invention; and FIG. 10 is a bottom plan view of the form of invention illustrated in FIG. 9.

DETAILED DESCRIPTION OF THE INVENTION

In FIG. 1, there is shown the application of the present invention in unitizing a plurality of boxes 20, preferably made of cardboard or like material, wherein anchor members 22 are employed at the juncture between three or four boxes and anchor members 24 are secured to the outer edge portions of two adjacent boxes.

As shown in FIGS. 2 to 4, anchor member 22 includes a flat body 26 which is substantially square in shape and is preferably made of a rigid plastic material such as polypropylene. Adjacent each corner of one face of body 26 is a cleat or pin 28 of predetermined length which is adapted to engage and penetrate the bottom wall of a container superimposed thereon. The opposite face of flat body 26 is also provided with corner cleats or pins 30 which are adapted to engage the top walls of adjacent containers. In addition to cleats or pins 30, there is also provided a T-shaped, flange-like wall 32 which extends outwardly from the face of body 26 and is formed integrally therewith, which wall is adapted to be inserted into the space between the boxes as illustrated to advantage in FIG. 1. T-shaped wall 32 includes a transverse portion 34 which extends between opposite sides of flat body 26 at substantially the midpoint of the body, as shown in FIG. 3, the transverse member being of substantial length and terminating proximate the side edges of the body.

T-shaped wall 32 also includes a leg portion 36 which extends from the midpoint of transverse portion 34 outwardly at a right angle to the latter to a point adjacent, but spaced from, one side of body 26. Portion 36 is also adapted for insertion in the space between adjacent containers, in the same manner as portion 34 for properly positioning the anchor member, as will be obvious from a consideration of FIG. 1.

Anchor member 24 is substantially the same in appearance as the lower half of the anchor member 22, shown in FIGS. 2 and 3. Anchor member 24 includes a rectangular flat body 38 of a rigid material, preferably of polypropylene plastic, one face of which is provided with a pair of cleats or pins 40 at the lower corners thereof. The opposite face of flat body 38 is provided with a T-shaped, flange-like wall 42 which comprises a transverse portion 44 extending for a substantial distance between the opposed sides of the flat body and proximate one side wall thereof as shown in FIG. 5. Wall 42 further includes a leg portion 46 which extends from the midpoint of transverse portion 44, and at a right angle thereto, to a point adjacent, but in spaced relation to, a side of flat body 38. The opposite face of body 38 is provided with a pair of corner cleats or pins 47 similar to cleats or pins 28 of anchor member 22.

It will be apparent from a comparison of FIGS. 3 and 5 that anchor member 24 may be formed simply by breaking away the upper portion of flat body 26 of anchor member 22, or may be separately molded since the lower half of anchor member 22 is structurally the same as the anchor member 24 of FIG. 5.

In FIG. 1, there is illustrated the manner of using anchors 22 and 24 in unitizing a plurality of boxes 20. Anchor 22 is placed at the juncture between either three or four boxes with T-shaped wall 32 thereof inserted into the space between the adjacent boxes. Pressure is exerted on the anchor member to force cleats or pins 30 into penetrating engagement with the top walls of the adjacent containers, as shown to advantage in FIG. 6, it being noted that where containers of the corrugated cardboard type are employed, cleats or pins 30 are preferably of a length to penetrate the outer wall portion, but do not penetrate the inner wall portion thereof. The impingement of the cleats or pins on the walls of adjacent boxes 20, coupled with the interpositioning of T-shaped wall 42 into the interstices between the boxes, positively precludes relative movement between the containers to effectively unitize the same for transportation and shipment.

Anchor members 24 are positioned in spanning relationship over the outer edge portions of the adjacent boxes 20, as also shown in FIG. 1. Leg portion 46 of T-shaped wall 42 extends into the space between boxes 20, and transverse portion 44 thereof extends downwardly into engagement with adjacent corners of the containers. This arrangement, plus the penetration of cleats or pins 40 positively prevents the outer ends of boxes 20 from spreading apart.

When additional boxes 20 are superimposed to provide a second layer to be unitized with the first layer, cleats 28 of anchor members 22 and cleats 40 of anchor members 24 engage the bottom walls of the container or containers, thereby holding the lower portion thereof against relative movement. Additional anchor members 22 and 24 would be applied to the upper layer of containers 20.

In FIGS. 7 and 8, there is illustrated a modified form of the present invention which is particularly adapted for use in unitizing a plurality of open cardboard trays or the like which hold goods such as bottles having reduced necks. In this form of the invention, anchor member is generally designated 50 and includes a flat body portion 52, one side of which is provided with a T-shaped flange-like wall 54, which includes a transverse portion 56 and a leg portion 58. Cleats or pins are indicated at 60.

It is a salient part of this form of the invention to provide, on the opposite face of flat body 52, a plurality of annular flange-like wall members 62, preferably four in number, which are adapted to fit over cap 64 of bottle 66 for holding the anchor member in place. Annular members 62 are preferably located proximate the corners thereof in order that the annular members may engage the caps of bottles in different trays.

It will be noted from a consideration of FIG. 7 that in the use of this form of the invention, the positioning of the anchor member with respect to containers is different from that of anchor members 22 and 24 since in actual use, anchor member 50 is disposed with T-shaped wall 54 extending upwardly for inserting between adjacent trays superimposed on the lower trays. In this form of the invention, the size of flat body 52 and the positioning of annular flange-like wall member 62 will necessarily be determined by the distance between caps 64 of adjacent trays.

In FIGS. 9 and 10, there is illustrated a further modified form of the present invention which is particularly adapted for unitizing a plurality of open trays holding cans. For this purpose, there is provided an anchor member 68 including a flat body 70, one face of which is provided with a T-shaped flange-like wall 72 having a transverse portion 74 and a leg portion 76. Cleats or pins are indicated at 78.

The opposite face of anchor member 68 is provided with a plurality of arcuate walls 80 preferably located adjacent the corners of body 70, which walls are adapted to engage the top lip of cans in adjacent trays, for positioning the anchor member. In this form of the invention, as in the form of invention illustrated in FIGS. 7 and 8, T-shaped flange-like wall 72 extends upwardly into the interstices between trays superimposed on the lower trays.

The anchor member of the present invention affords simple, economical means for application to a plurality of containers for holding the same together of facility in moving the containers as a unit from place to place. The present anchor member is also readily positioned and removed from the containers in a minimum of time, and without the use of special tools.

While there has been herein shown and described the presently preferred forms of the invention, it is to be understood that such has been done for purposes of illustration only, and that various changes may be made therein within the scope of the appended claims.

What is claimed is:

1. An anchor member for unitizing a plurality of containers including:
   a. substantially flat body for placement at the juncture between a plurality of laterally adjacent containers having flat surfaces disposed in substantially the same plane, one face of said flat body being engaged with a portion of the flat surfaces of adjacent containers,
   b. wall means extending outwardly from said face of the substantially flat body for engagement with portions of adjacent containers proximate the flat surfaces engaged by said flat body, to hold the anchor member in position, and
   c. means projecting outwardly from said face of the flat body for grippingly engaging portions of the flat surfaces of the adjacent containers to prevent relative movement thereof.

2. The anchor member of claim 1, wherein:
   a. said means on the body face for grippingly engaging the walls of the adjacent containers comprises a plurality of cleats.

3. The anchor member of claim 1, wherein:
   a. said body is provided with a second face, and
   b. means on said second body face for grippingly engaging the walls of adjacent containers positioned thereon.

4. The anchor of claim 3, wherein:
   a. said means on said second body face for grippingly engaging the walls of adjacent containers comprise a plurality of cleats.

5. The anchor member of claim 1, wherein:
   a. said body is provided with a second face, and
   b. second wall means on said second body face for engaging and holding goods within the containers.

6. The anchor member of claim 5, wherein:
   a. said second wall means is of annular shape.

7. The anchor member of claim 5, wherein:
a. said second wall means is of arcuate shape.
8. The anchor member of claim 1, wherein:
a. said wall means includes a flange-like member extending transversely of said flat body.
9. An anchor member for unitizing a plurality of containers, including:
a. a substantially flat body of rigid material for placement at the juncture between a plurality of laterally adjacent containers having flat surfaces disposed in substantially the same plane,
b. a wall member extending outwardly from one face of said body and including a first part extending transversely between opposite sides of said body for engagement with wall portions of adjacent containers,
c. said wall member including a second part extending from said first part at a point intermediate the length thereof towards a side of said body for engagement with wall portions of adjacent containers, and
d. spaced means projecting outwardly from said face of the flat body for grippingly engaging portions of the flat surfaces of the adjacent containers whereby the containers are unitized and held against relative movement during transportation.
10. The anchor member of claim 9, wherein:
a. said wall member is of substantially T-shape configuration.
11. The anchor member of claim 10, wherein:
a. said T-shape member is located on substantially half of the body face.
12. The anchor member of claim 10, wherein:
a. said first portion of the T-shaped wall member is located adjacent a side edge of said flat body.
13. The anchor member of claim 9, with the addition of:
a. a plurality of spaced cleats extending outwardly from a second face of said flat body for penetrating and grippingly engaging adjacent containers, whereby the containers are unitized and held against relative movement during transportation.
14. The anchor member of claim 9, with the addition of:
a. a second wall member extending outwardly from a second face of said flat body for engaging and holding goods within the containers.
15. The anchor member of claim 14, wherein:
a. said second wall member is of annular shape.

* * * * *